United States Patent [19]

Ferguson

[11] Patent Number: 4,592,936

[45] Date of Patent: Jun. 3, 1986

[54] ORNAMENTAL ARTICLE WITH INTERNAL DISPLAY BRACKET

[76] Inventor: Daryl A. Ferguson, 888 Broomley Rd., Charlottesville, Va.

[21] Appl. No.: 666,683

[22] Filed: Oct. 31, 1984

Related U.S. Application Data

[63] Continuation-in-part of Ser. No. 636,019, Jul. 30, 1984, abandoned.

[51] Int. Cl.[4] ..... A47G 33/08

[52] U.S. Cl. ..... 428/11; 428/35

[58] Field of Search ..... 428/3, 7, 11, 35

[56] References Cited

U.S. PATENT DOCUMENTS

| | | | |
|---|---|---|---|
| 2,095,648 | 10/1937 | Oftedahl | 428/11 X |
| 2,742,725 | 4/1956 | Esposito, Jr. | 428/11 X |
| 3,292,840 | 12/1966 | Schmidt | 428/11 X |
| 3,624,939 | 12/1971 | Gossard | 428/11 X |
| 3,694,648 | 9/1972 | Yates | 428/11 X |
| 4,173,667 | 11/1979 | Rusch | 428/11 |
| 4,224,364 | 9/1980 | Hunt | 428/11 |

*Primary Examiner*—Henry F. Epstein

*Attorney, Agent, or Firm*—Kenyon & Kenyon

[57] ABSTRACT

The present invention relates to a decorative ornamental object suitable for use as a Christmas ornament, Valentine heart, Easter egg or other holiday or occasion-related article. The ornamental object comprises a hollow housing having an aperture for viewing the inside of the housing. The present invention provides for mounting a picture, personalized message, and other two- and three-dimensional elements inside the housing which may be viewed through the viewing aperture. These display elements may be easily placed in or removed from the ornamental object. In addition, the ornamental object may be used as a gift container.

21 Claims, 21 Drawing Figures

Fig. 6.
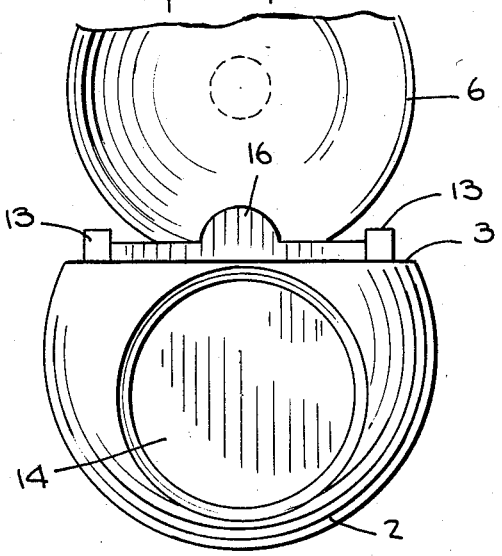
Fig. 7.
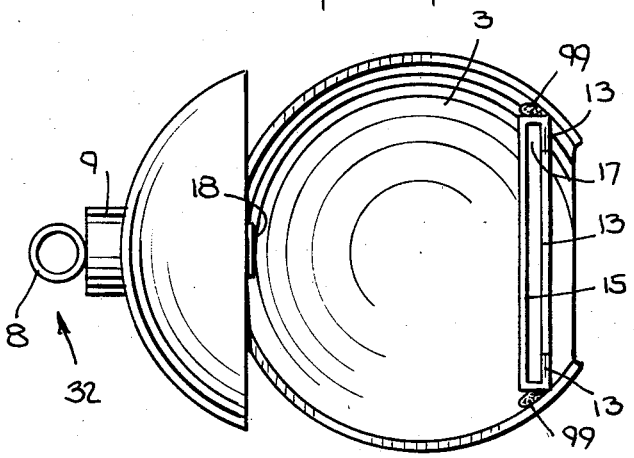
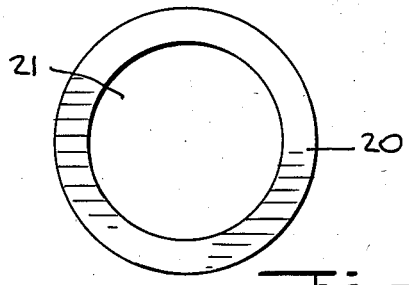
Fig. 8.
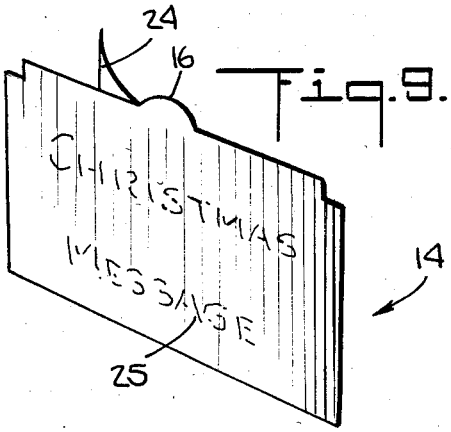
Fig. 9.
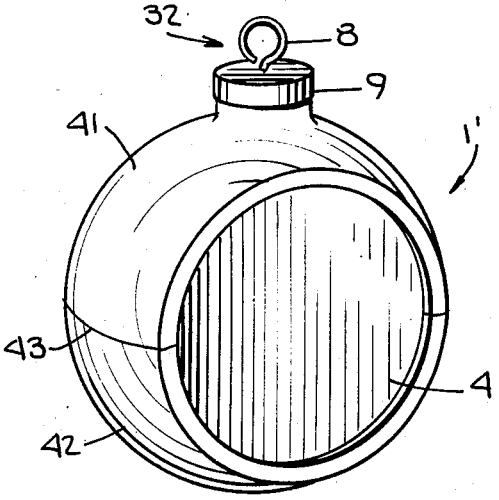
Fig. 10.
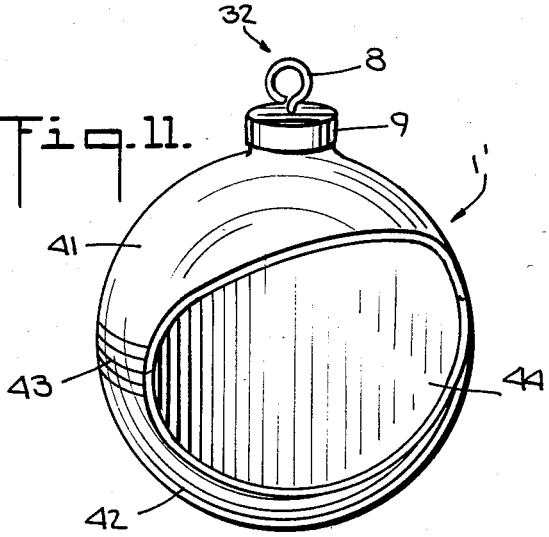
Fig. 11.

Fig. 18.
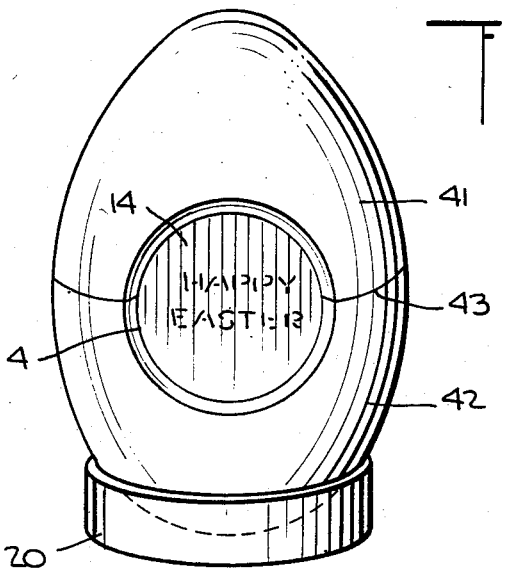
Fig. 19.
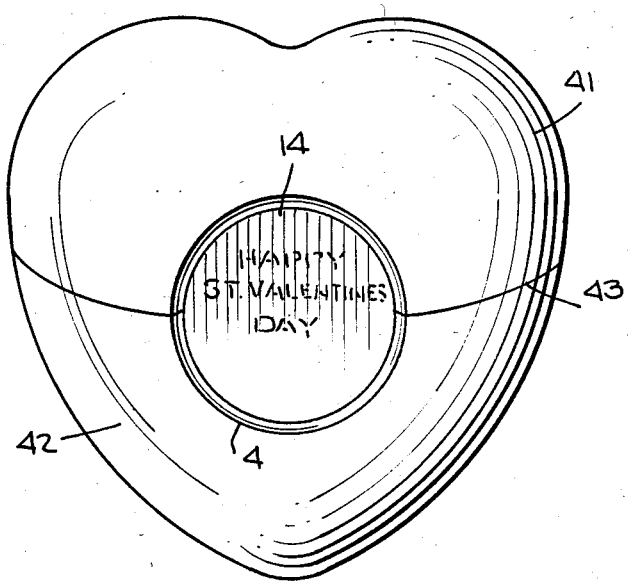
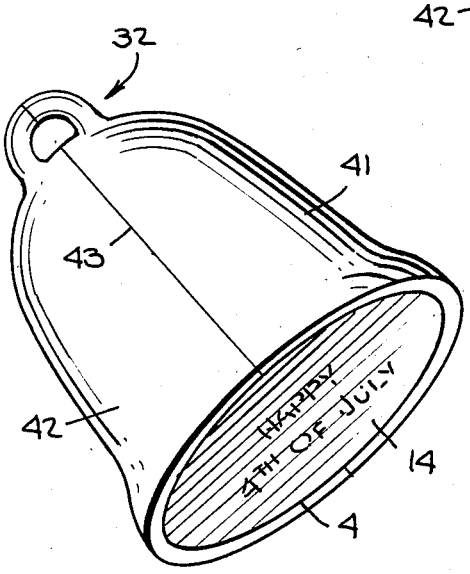
Fig. 20.

ORNAMENTAL ARTICLE WITH INTERNAL DISPLAY BRACKET

This application is a continuation-in-part of my copending application Ser. No. 636,019, filed July 30, 1984 and now abandoned.

The present invention relates to ornamental articles such as Christmas tree ornaments, Valentine hearts, Easter eggs and other holiday or occasion-related articles. More particularly, the present invention relates to ornamental articles which includes a self-contained mounting bracket for displaying a picture, message, or the like and may also be used as a gift container.

BACKGROUND OF THE INVENTION

Ornamental display devices for displaying two and three dimensional elements have long been known. These devices typically take the form of Christmas ornaments, and the like but other shapes are known.

However, the devices known to date suffer from several problems which detract from their use. Many of the devices, while they do display a message or picture, do not allow for changing that message. In addition, many of the devices that do provide for interchangeable pictures or messages require complete disassembly of the display device to do so. Still others require illumination to properly view the displayed element or require that the device be opened to view the displayed element.

It is therefore an object of this invention to provide a display device that allows for simplified interchange of the displayed elements without disassembly of the device and that affords clear and easy viewing of the displayed elements.

It is another object of the invention to provide a display device suitably shaped for use on Christmas, Valentine's Day, Easter, anniversaries, birthdays and other holidays or occasions.

It is still another object of the invention to provide an article suitable for containing a gift.

Additional objects and advantages of this invention will become apparent from the following description and claims in conjunction with the drawings.

SUMMARY OF THE INVENTION

The objects of this invention are accomplished by providing a hollow housing which may be of any size or shape depending on the occasion for which it is intended. For example, at Christmas the housing may be spherical or ball-shaped, on Valentine's Day or for an anniversary the housing may be bell-shaped or heart-shaped, on Easter the housing may be egg-shaped and so on. The housing has a top opening for engaging a cap or lid and at least one other aperture for viewing the interior of the housing. This viewing aperture may be of any shape. The housing may be constructed of any suitable material such as metal or preferrably plastic. In addition, the top opening is large enough to admit the object to be displayed into the housing.

The lid is suitably made of the same material as the housing and generally conforms with the shape of the housing. The lid is attached in the housing top opening in such a way as to be easily removable and replaceable. One way of accomplishing this is to provide a narrowing of the diameter of the lid at the point where the lid is engaged by the housing. The lid should be narrowed just enough so that a friction fit is created between the lid and the housing and a force must be applied to the lid for it to be removed. This method will work equally as well if the housing itself contains the narrowed section and this section fits inside the lid.

A variation on the above method involves providing small pins perpendicular to the outside of the narrowed section that can be engaged by a comparable number of like-sized holes near the open edge of the lid or housing, whichever does not contain the pins. When the housing and lid are fitted together the holes engage the pins and the device is held together.

In addition to the above methods, the lid may be removably held in place through the use of a hinge, a screw lock or screw threads.

The interior of the ornamental device contains display holding means such as a bracket or like device for positioning and removably holding the element to be displayed. This bracket is oriented so that the element to be displayed may be inserted through the top opening of the housing into the display holding bracket and the inserted object is thereby positioned so that it may be viewed through the viewing aperture in the housing. The display holding bracket may take the form of a picture frame-like structure disposed inside the housing with its front surface facing the viewing opening in the housing. This structure comprises a generally flat backing member having an L-shaped member projecting out from the front surface of the backing member for engaging and removably holding the element to be displayed. The backing member may be of any suitable shape such as circular, rectangular, or octagonal, and may suitably conform with the shape of a cross-section of the housing taken in a plane behind and parallel to the viewing aperture. The L-shaped member projects out from the edge of the front surface of the backing member, and typically follows along that edge except for a portion of the edge adjacent to the top opening. This allows for the insertion into the holding bracket of the element to be displayed. The backing member may be a separate piece that is fixed inside the housing or the housing and bracket may be molded as one piece as with injection molded plastic.

The ornamental device of the present invention may be provided with hanging means such as a wire loop attached to the outside of the housing to facilitate suspending the device from a stand or tree. Alternatively, a cup shaped ring base may be provided on which the ornamental device may be placed and can then be displayed on a table, shelf or desk.

The outside of the housing may be left plain or it may be decorated or ornamented with drawings, pictures or other suitable images. In addition, a textured surface may be provided on the outside of the housing. Furthermore, the housing may be covered with a plastic, fiberglass, cloth fabric or strand material to provide for a colorful, interesting and attractive appearance.

The object to be displayed is suitably mounted on some type of stiff-backed material such as cardboard of a size suitable to fit into the display holding means. The object is typically a picture, display, message or other suitable image. Alternatively, rather than a picture or image, the stiff-backed material may have mounted to it a three-dimensional object.

The stiff-backed material may be provided by the user but can be provided as part of the ornamental device. The stiff-backed material may take the form of a thin piece of cardboard being sized to fit in and be engaged by the holding means. The material would have a front side containing some type of image. Alternatively, the front or back of the material may be coated with an adhesive so that a personalized display could easily be constructed. In the case where more than one viewing aperture is provided more than one bracket each with its own display element may be provided inside the housing, so that a different display may be viewed in each of viewing apertures.

An alternative way of accomplishing the objects of the present invention involves a housing which is comprised of a top and bottom housing section. Each section has an aperture at its edge positioned such that when the two sections are joined a viewing aperture is formed in the housing.

As with the lid/housing configuration, the housing sections may be joined together in many ways including a friction fit, pins and holes, a hinge and the like, which are described above.

The display bracket for this embodiment is similar to that of the first embodiment except that in this embodiment the backing member of the display bracket is split in half along a line parallel to the split between the two housing sections. Therefore, when the two housing sections are split a portion of the bracket remains with the bottom housing section and the remainder of the bracket is contained inside the top housing section. In addition, the backing member may be constructed so that the two backing member portions latch together when the two housing sections are joined, and thus increase the support provided for the display element.

As with the lid/housing embodiment, the housing sections embodiment may be provided with hanging or displaying means, may have a decorated or ornamental surface and will contain some type of display element, all of which have been described above.

The display devices of the present invention can obviously be used to display personal or seasonal two or three dimensional elements such as pictures, messages and so on and may be hung from a tree, stand or displayed on a table or bookshelf.

In addition, since the ornamental device is hollow, the inside area of the housing may be used as a receptacle for small gifts. A small gift such as pieces of jewelry, small toys, candy and the like may be placed in the hollow portion of the display device behind the display bracket. In addition, the display element may be geared to the recipient of the gift. In this way the gift is presented in a personalized gift container and the recipient can reuse the container to give another gift, as a display on a tree or shelf, or even as a storage unit for the gift received.

BRIEF DESCRIPTION OF THE DRAWINGS

FIG. 6 is a schematic front view showing the displayed element inside the ornamental device oriented towards the viewing aperture with a hinged lid in the open position.

FIG. 7 is a schematic top view of the ornamental device showing the hollow inside and the location of displayed element holding means.

FIG. 8 is a view of the stand used to support the display device.

FIG. 9 is a view of a possible display element for the display device.

FIG. 10 is a perspective view of another embodiment of the present invention.

FIG. 11 is a perspective view of the ornamental device of the invention with an oblong viewing aperture.

FIG. 18 is a perspective view of an alternate shape for the display housing.

FIG. 19 is a perspective view of another alternate shape for the display housing.

FIG. 20 is a perspective view of still another alternate shape for the display housing.

DETAILED DESCRIPTION OF THE INVENTION

Figure 1:
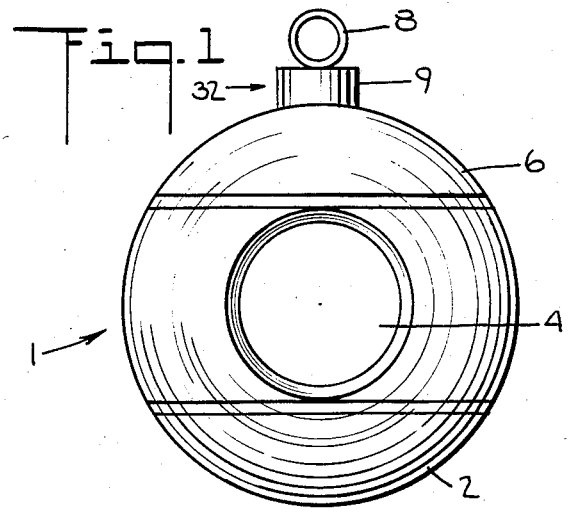
FIG. 1 is a schematic front view of the ornamental device in accordance with one embodiment of the present invention.
Figure 2:
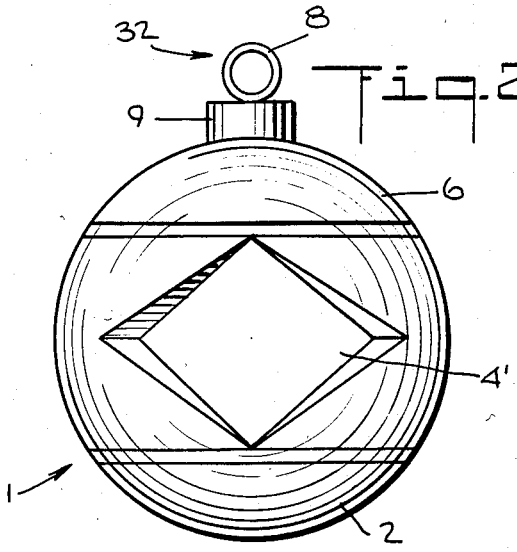
FIG. 2 is a schematic front view of the ornamental device with an alternative viewing aperture shape.
Figure 3:
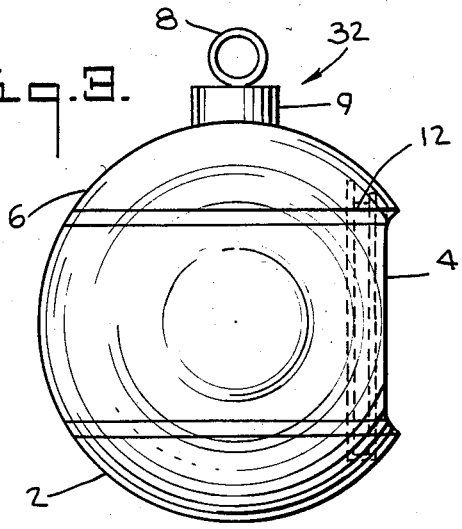
FIG. 3 is a schematic side view of the ornamental device of this invention.
Figure 4:
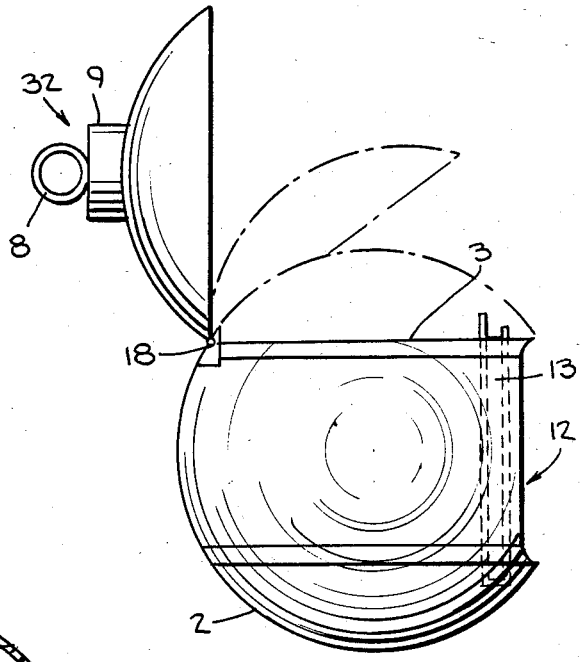
FIG. 4 is a schematic side view of the ornamental device showing one embodiment for mounting the lid.
Figure 5:
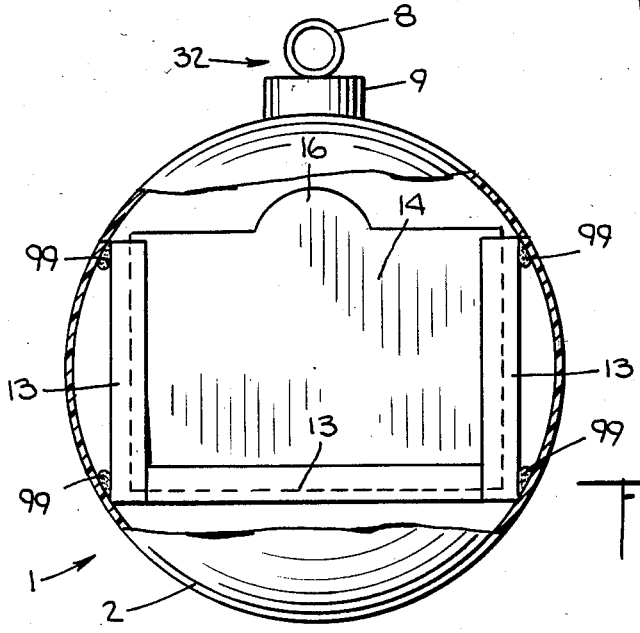
FIG. 5 is a broken away schematic front view with parts removed of the ornamental device showing the displayed element.
Figure 12:
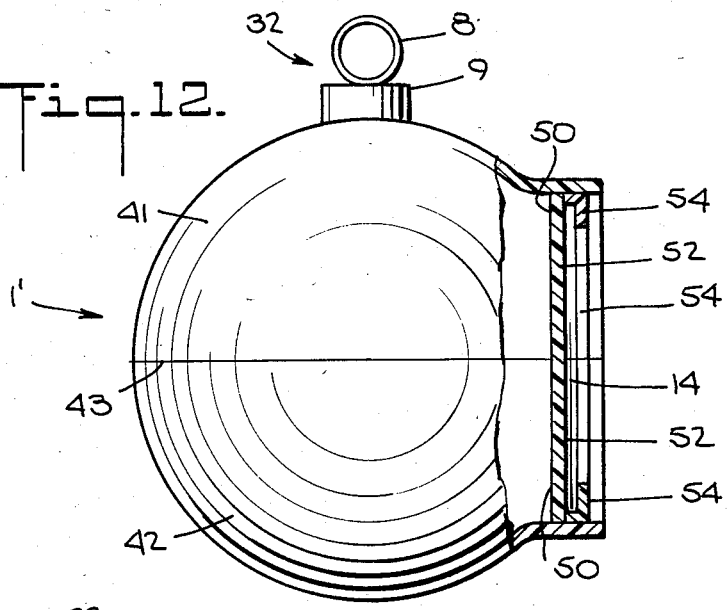
FIG. 12 is a side view partially in cross-section of another embodiment of the display mounting bracket.
Figure 13:
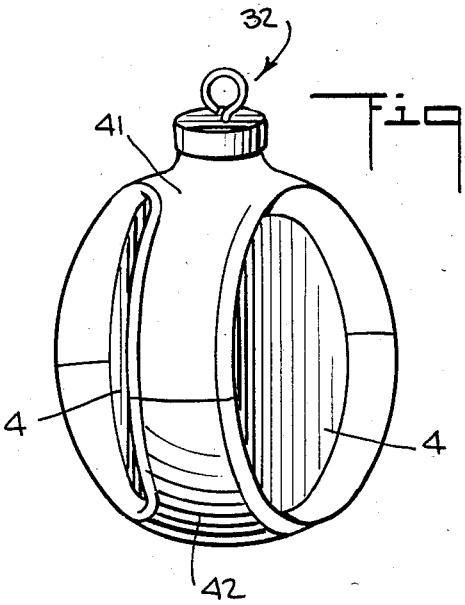
FIG. 13 is a perspective view of another embodiment of an ornamental display device having three viewing apertures.
Figure 13A:
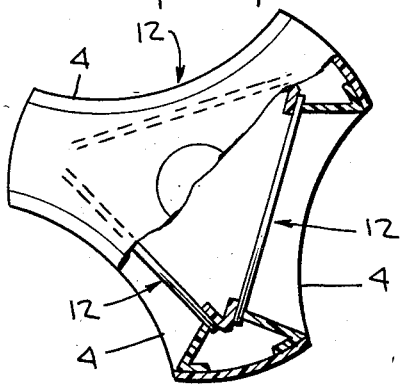
FIG. 13A is a schematic top view of another embodiment of the display device having three viewing apertures.

Referring more specifically to the drawings, the numeral 1 broadly indicates an ornamental display device having a hollow housing 2. The housing may be any shape but the preferred shape is spherical or ball-like. It can be of any size but typically it has a diameter of about 3–4 inches.

The first embodiment of the present invention is illustrated in FIGS. 1–9. In this embodiment, the housing 2 has a top opening 3 for admitting the element, picture or object to be displayed. The housing also may have one or more viewing apertures 4 which allows for viewing the inside of the housing. The viewing aperture may be of any shape but typical shapes are circular 4, diamond shaped 4' in FIG. 2, or oblong 44 in FIG. 11.

The top opening 3 in the housing 2 may be covered with a small lid 6. This lid should be shaped so that its exterior surface follows the same general shape as that of the exterior of the housing and conforms with the housing at the point where the housing and the lid come together.

The lid 6 and the housing 2 can be made of any suitable material such as metal or injection molded plastic.

The interior of the housing 2 contains at least one picture frame-like bracket or mounting bracket 12 for engaging and positioning the displayed element 14 to be displayed in front of the viewing aperture 4. The mounting bracket can take many forms but the preferred form comprises a thin, generally flat backing member 15 with its front surface facing and oriented generally parallel to the viewing aperture 4 and having a top portion located just below the lid and a bottom end located near the bottom of the housing 2. An L-shaped member 13 is positioned along the edge of the front surface of the backing member 15, except for the portion of the backing member 15 which is adjacent to the lid 6. The L-shaped member 13 is shaped and positioned in such a way as to form a channel 17 along the edge of the front surface of the backing member 15. The L-shaped member 13 is further positioned such that the channel 17 is directed towards the center of the front surface of the backing member 15. The channel 17 engages the edge of whatever element that is to be displayed in the housing. Backing member 15 and engaging members 13 may be formed from a single piece of material, such as sheet material, and may be mounted in housing 2 such as by glue 99.

While the mounting bracket 12 illustrated is rectangular, the present invention is not limited to that shape. The shape usually will conform with the shape of the housing near the viewing aperture and the L-shaped member that forms the engaging channels will be formed near the edge of the front surface of the backing member in such a way as to engage and removably hold the element to the display.

The lid 6 of the present invention may be held in place over the top opening 3 in the housing 2 in many ways. One such way is to employ a hinge 18 attached along the edge of the lid 6 and the housing 1 to keep the lid in place but allow the lid 6 to be easily pivoted out of the way so the display element may be placed within or removed from the interior of the housing. Other techniques such as a friction fit and a pin/hole arrangement are also useful in removably positioning the lid 6 over the top opening 3 in the housing and may be employed in combination with the hinge mounting. These techniques will be presented in more detail below when the second embodiment of the present invention is presented.

Hanging means 32 may comprise a suitable hanger having a loop 8 connected to a cap 9 mounted to or formed by an outer portion of the lid 6 of the ornamental device 1. This will allow the ornamental device to hang or be suspended from a tree or some type of stand. Alternatively, the ornamental device may be placed in a base 20 which is shown in FIG. 8. This base comprises a short cylinder member 20 having a bore 21 extended therethrough. The diameter of the cylinder should be smaller than the largest dimension of the display device. One end of the cylinder is placed on a flat surface and the second end receives the bottom portion of the display device.

A typical display element 14 is shown in FIG. 9. This display element may comprise a stiff cardboard-like material which is sized and shaped to fit into and be engaged by the mounting means 12 inside the housing 1. The display element usually contains some preprinted message or image 25 on its front surface and is provided with an adhesive surface on its back. Any suitable adhesive, contact cement or pressure sensitive material may be employed. This adhesive surface is used to create personalized display elements. Messages, images and the like may be fixed to the display element using this adhesive surface. The adhesive surface is usually covered by a thin sheet of paper-like material 24 that protects the adhesive surface until it is used. The display element 14 is also provided with a tab 16 along its top edge to facilitate removal from or placement in the display device.

Additional embodiments of the present invention are illustrated in FIG. 10–20. In these embodiments, the housing 1 consists of a top section 41 and a lower section 42 each section containing a portion of the viewing aperture 4. The two sections are joined together along their mating end 43 such that the two portions of the viewing aperture 4 line up and a complete housing and viewing aperture is formed.

Figure 14:
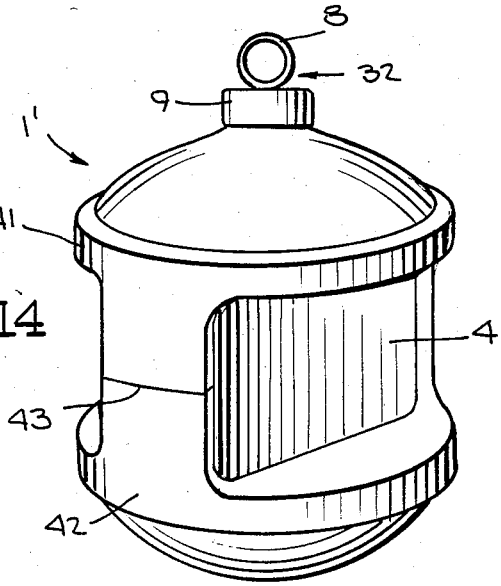
FIG. 14 is a perspective view of an alternate shape for the ornamental device housing.
Figure 15:
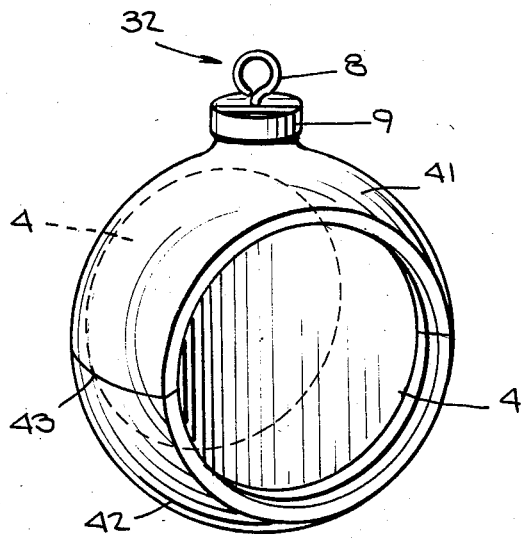
FIG. 15 is a perspective view of an ornamental device having a double display holding bracket.
Figure 16:
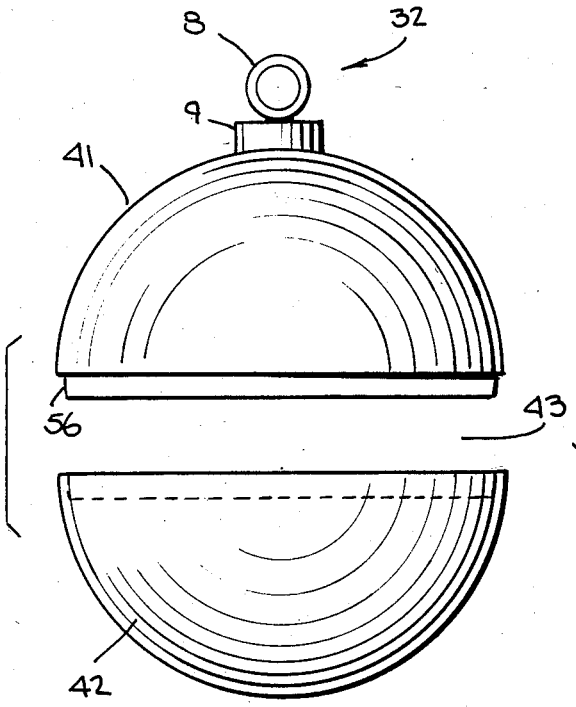
FIG. 16 is a side view of the housing sections joined together with a friction fit.
Figure 17:
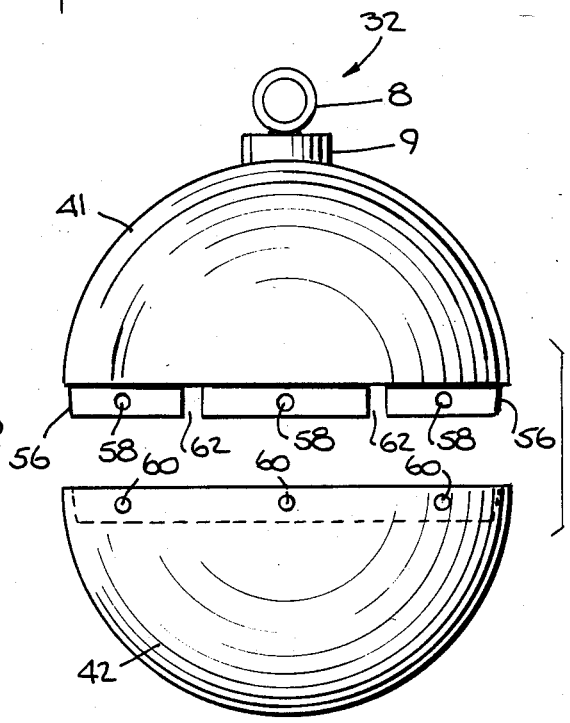
FIG. 17 is a side view of the housing sections joined together with a pin/hole arrangement.

The housing 1 formed when housing sections 41 and 42 are joined is usually shaped to suit the season or occasion on which it is used. This possibility is illustrated throughout the drawings but specific shapes other than spherical are illustrated in FIG. 14 (oblong), FIG. 18 (egg shaped), FIG. 19 (heart shaped) and FIG. 20 (bell shaped).

The interior of the housing sections 41 and 42 contain at least one picture frame or mounting bracket 12, for engaging the display element 14 to be displayed in front of the viewing aperture 4. The bracket is comprised of a thin, generally flat backing member 50 positioned inside each of the housing sections 41 and 42. The backing members extend within the inside portion of each housing section, enough to provide support for the element to be displayed in the display device. The backing member is positioned so that its front surface 52 faces the viewing aperture 4. Typically, this means that the backing member will extend far enough such that when the housing sections 41, 42 are joined each backing member 50 will almost come in contact with the end of the other backing member. However, each backing member need not extend the same length. In addition, along the edges of the front surface of the backing member 50 is an L-shaped member 54 positioned in such a way as to form a channel along the edge of the front surface 52 of the backing member 50. These channels engage the edges of the element 14 that is to be displayed in the housing.

The housing sections of this embodiment may be engaged together in several ways including a hinge as discussed above. One of the preferred ways, however, involves providing a narrowed portion 56 at the open circumferential edge of the section in one of the housing sections. The narrowed portion of one housing section should just fit inside the open circumferential edge 57 of the second housing section thus forming a friction fit that will keep the two housing sections from separating unless force is applied.

A further modification of this embodiment is to provide a plurality of pins 58 perpendicular to the outside surface of the narrowed portion provided in one of the housing sections, e.g., section 41, located near the open circumferential edge 43 of said housing section. The pins 58 will be engage holes 60 located in a comparable position in the other housing section 42 when housing section 41, which is made flexible, is temporarily deformed, inserted into housing section 42 and then assumes its undeformed geometry. In addition, a slot 62 may be provided on either side of each aperture to increase the flexibility of the housing section in that area to facilitate engaging and disengaging of the housing sections. The pins 58 and holes 60 may be round or any other suitable shape such as square, rectangular and the like.

The remainder of the features of this second embodiment are comparable to the features of the first embodiment. This embodiment may have hanging or displaying means, can be provided with a display element, may have a textured, decorated or plain outer surface, can have a plurality of viewing apertures and can be made of materials such as metal or plastic.

The details in the drawings and specifications are presented to show preferred embodiments and are not intended to limit the present invention as defined in the appended claims.

What is claimed is:

1. An ornamental display object for displaying an element or gift which comprises:

a hollow housing having an opening for providing access to an inner portion of said housing and an aperture for viewing said inner portion of said housing;

means disposed within said inner portion for positioning and removably holding the element to be displayed adjacent to said aperture; and means coupled to the housing adjacent to said opening for covering said opening, said covering means being movable away from said opening for providing access to said inner portion of said housing through said opening so that the display element may be easily changed and said inner portion may receive and store small articles, the opening being sized to admit said element and said gift and the covering means conforming generally to the shape of said housing.

2. The ornamental display object of claim 1 which further comprises hanging means connected to said housing for displaying said object.

3. The ornamental display object of claim 1 which further comprises a decorative covering on the exterior of the housing.

4. The ornamental display object of claim 1 wherein said housing has a plurality of viewing apertures with display element positioning and holding means associated with each said aperture.

5. The ornamental display object of claim 2 wherein the hanging means comprises:

a cap formed on the surface of said ornamental object; and a loop attached to said cap.

6. The ornamental display object of claim 1 further including a display element disposed in said positioning and holding means.

7. The ornamental display object of claim 6 wherein the display element comprises:

a thin, stiff-backed member having a front surface and a back surface said member being of a size such that it will fit in and be engaged by the holding means said member being placeable in said holding means with either its front or back surface facing said aperture;

a pre-printed image on said front surface; and an adhesive coating on said back surface on which a personal image may be placed.

8. An ornamental display object for displaying an element which comprises:

a hollow housing having a top opening and a viewing aperture;

a lid removably mounted over and covering said top opening, wherein the shape of said lid generally conforms to the shape of said housing;

a generally flat, backing member mounted inside said housing, said member having a front surface facing the viewing aperture; and a member having an L-shaped cross-section formed along the edge of said front surface except for a portion of the edge adjacent to the top opening, said L-shaped member forming a channel along said edge, wherein said channel engages and said backing member supports the element to be displayed.

9. The ornamental display object of claim 8 which further comprises hanging means connected to said housing for displaying said object.

10. The ornamental display object of claim 8 wherein the lid frictionally engages the edge of said top opening.

11. An ornamental display object for displaying an element which comprises:

a housing having a first shell portion adjacent to a second shell portion thereby defining a housing having a hollow interior, said housing having at least one aperture in the side thereof with a first portion of said one aperture being located in the first shell portion and an adjacent second portion of said one aperture being located in said second shell portion;

means for connecting said first shell portion to said second shell portion;

a generally flat backing member having a first section and a second section with the first section located in said first shell portion, and the second section located in said second shell portion, said backing member having a front surface facing the viewing aperture, wherein said backing member sections are located such that they are aligned when said shell portions are joined; and a member having an L-shaped cross-section formed along the edge of said front surface, said L-shaped member forming a channel along said edge for receiving said display element.

12. The ornamental display object of claim 11 which further comprises hanging means connected to said housing for displaying said object.

13. The ornamental display object of claim 11 wherein said connecting means comprising a narrowed section provided at the circumferential edge of said first shell portion such that when the shell portions are joined said narrowed section will fit within and frictionally engage said second shell portion.

14. The ornamental display device of claim 13 wherein said connecting means further comprises a plurality of pin-like members projecting outwardly from said narrowed section, said pin-like members being received when said shell portions are joined by a plurality of corresponding holes disposed around the circumferential edge of said second shell portion, said narrowed section further including a slot disposed between each pin-like member.

15. The ornamental display object of claim 11 further comprising a display element removably engaged by said L-shaped member.

16. The ornamental display object of claim 14 wherein the display element comprises:

a thin, stiff-backed member having a front surface and a back surface said member being of a size such that it will fit in and be engaged by said L-shaped member, said stiff-backed member being placeable in said L-shaped member with its front surface facing said aperture; and a pre-printed image on said front surface.

17. The ornamental display object of claim 11 wherein a small article is contained within said hollow interior.

18. The ornamental display object of claim 11 wherein said housing is spherical.

19. The ornamental display object of claim 11 wherein said housing is egg-shaped.

20. The ornamental display object of claim 11 wherein said housing is bell-shaped.

21. The ornamental display object of claim 11 wherein said housing is heart-shaped.

* * * * *